US005951332A

United States Patent [19]

Wang

[11] Patent Number: 5,951,332

[45] Date of Patent: Sep. 14, 1999

[54] ELECTRIC FEMALE CONNECTOR FOR USE IN A CARAVAN

[76] Inventor: Jen-Ching Wang, No. 27, Alley 4, Lane 446, Fu Hsin Rd., Shu Lin Chen, Taipei County, Taiwan

[21] Appl. No.: 09/226,202

[22] Filed: Jan. 7, 1999

[51] Int. Cl.[6] ..... H01R 13/502

[52] U.S. Cl. ..... 439/686; 439/682

[58] Field of Search ..... 439/686, 682; 599/634, 684, 695, 701

[56] References Cited

U.S. PATENT DOCUMENTS

| | | | |
|---|---|---|---|
| 3,783,440 | 1/1974 | Karube et al. | 339/217 R |
| 4,179,179 | 12/1979 | Towden | 339/186 M |
| 4,784,617 | 11/1988 | Oda | 439/595 |
| 4,834,677 | 5/1989 | Archang et al. | 439/660 |
| 4,921,456 | 5/1990 | French | 439/851 |
| 5,344,331 | 9/1994 | Hoffman et al. | 439/138 |
| 5,855,493 | 1/1999 | Shelly | 439/465 |

*Primary Examiner*—Steven L. Stephan
*Assistant Examiner*—Chandrika Prasad
*Attorney, Agent, or Firm*—Varndell Legal Group

[57] ABSTRACT

An electrical female connector installed in a caravan for connection to a matching electrical male connector including a first terminal and a plurality of second terminals respectively mounted in axially extended center through hole and axially extended border through holes at a connector body inside a housing and connected to respective electrical wires of a cable fastened to the housing, wherein the connector body has a plurality of radial through holes through which screw can be respectively inserted and threaded into a respective screw hole at each second terminals to fix the respective electrical wires to the second terminals; the axially extended border through holes of the connector body are stepped, hexagonal through holes; the second terminals are stepped terminals each having a hexagonal upper section respectively fitted into and received inside the stepped, hexagonal border through holes at the connector body.

1 Claim, 8 Drawing Sheets

ELECTRIC FEMALE CONNECTOR FOR USE IN A CARAVAN

BACKGROUND AND SUMMARY OF THE INVENTION

The present invention relates to an electric female connector for use in a caravan, and more particularly to such an electric female connector that can be quickly assembled, keeping electrical wires positively separated from one another.

FIGS. 1 through 6 show an electrical female connector for use in a caravan to match with an electrical female connector. This structure of electrical female connector comprises a housing, a connector body mounted within the housing, the connector body having an axially extended center through hole and a plurality of axially extended border through holes spaced around the center through hole, a first terminal and a plurality of second terminals respectively mounted in the through holes at the connector body, and a cable fastened to the housing, the cable comprising a plurality of electrical wires respectively connected to the terminals. The terminals each have an upper part extended out of the top side wall of the connector body, an axially extended through hole, and a radial screw hole in communication with the axial through hole. Screws are respectively threaded into the screw holes to fix the respective electrical wires to the axial through holes of the terminals. This structure of electrical female connector has numerous drawbacks as outlined hereinafter.

1. Because the terminals are axially inserted into the respective through holes at the connector body and no means is provided to stop the terminals in place, the terminals tend to be moved axially in the respective through holes upon connector of the electrical male connector to the electrical female connector.

2. Because the terminals are respectively extended out of the top side wall of the connector body and the heads of the screws must be disposed outside the terminals, a short circuit may occor during installation of the screws with a screwdriver.

3. Because the terminals are respectively extended out of the top side wall of the connector body, the conductors of the electrical wires that are connected to the second terminals may touch the first terminal, causing a short circuit.

4. When turning the screws in the screw holes with a screwdriver, the screwdirver may touch the periphery of the metal connector body, causing a short circuit.

The present invention has been accomplished to provide an electrical female connector which eliminates the aforesaid drawbacks. According to one aspect of the present invention, the border through holes of the connector body for the second terminals are stepped, hexagonal through holes, and the second terminals are stepped, hexagonal terminals fitting the stepped, hexagonal border through holes. According to another aspect of the present invention, the connector body has radial through holes respectively disposed in communication with the axially extended border through holes for installation of screws in the screw holes at the second terminals to fix the respective electrical wires in place and stop the respective terminals from axial movement in the respective border through holes. According to still another aspect of the present invention, the second terminals are shorter than the border through holes, therefore the second terminals can be completely received inside the respective border through holes to prevent a short circuit.

DETAILED DESCRIPTION OF THE PREFERRED EMBODIMENT

Figure 1:
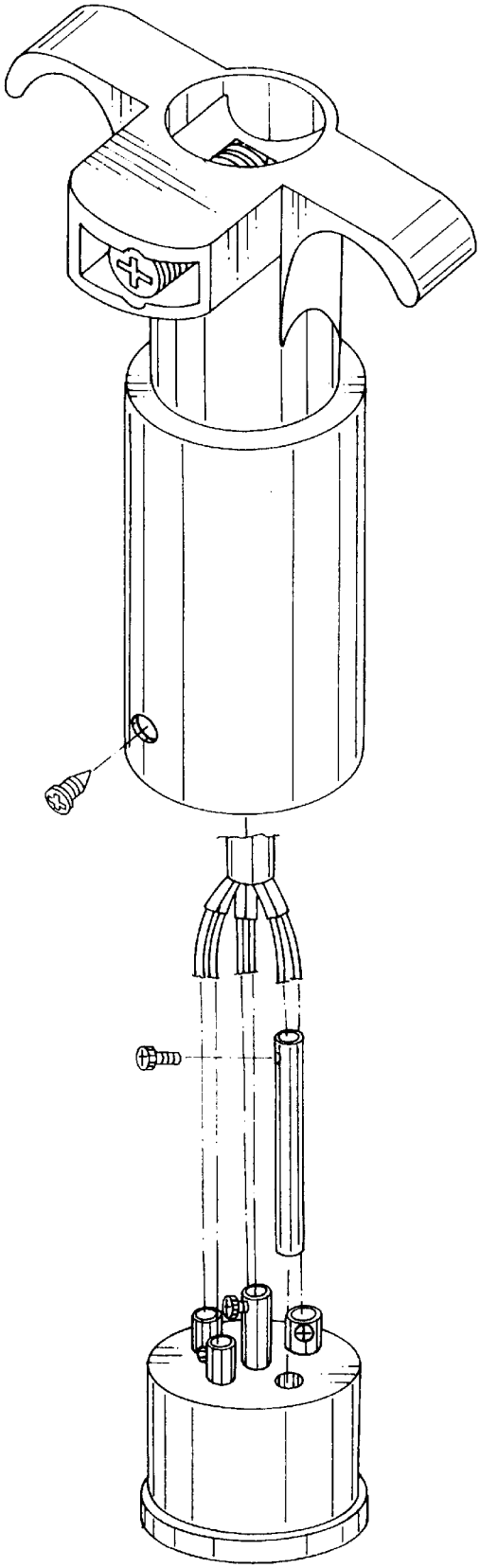
Fig. 1 PRIOR ART
FIG. 1 is an exploded view of an electrical female connector for use in a caravan according to the prior art.
Figure 2:
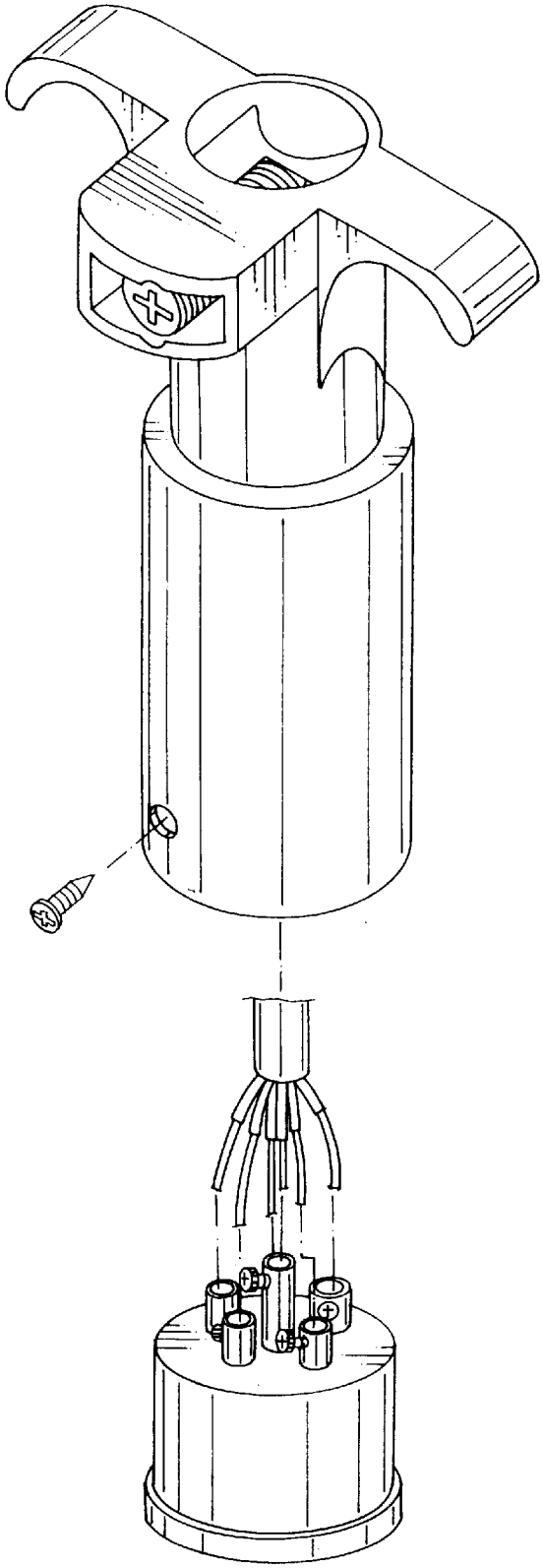
Fig. 2 PRIOR ART
FIG. 2 is an assembly view of the prior art electrical female connector.
Figure 3:
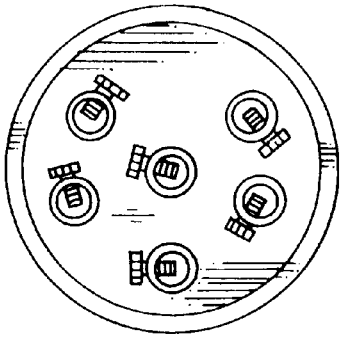
Fig. 3 PRIOR ART
FIG. 3 is a top view of the prior art electrical female connector.
Figure 4:
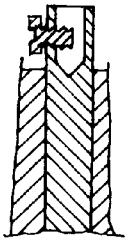
Fig. 4 PRIOR ART
FIG. 4 is a sectional view of a part of the prior art electrical female connector.
Figure 5:
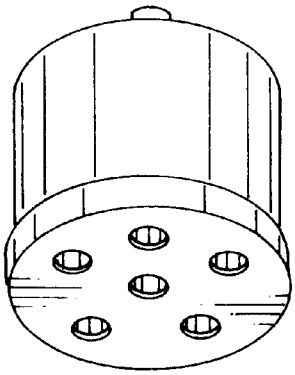
Fig. 5 PRIOR ART
FIG. 5 is a perspective of the connector body according to the prior art.
Figure 6:
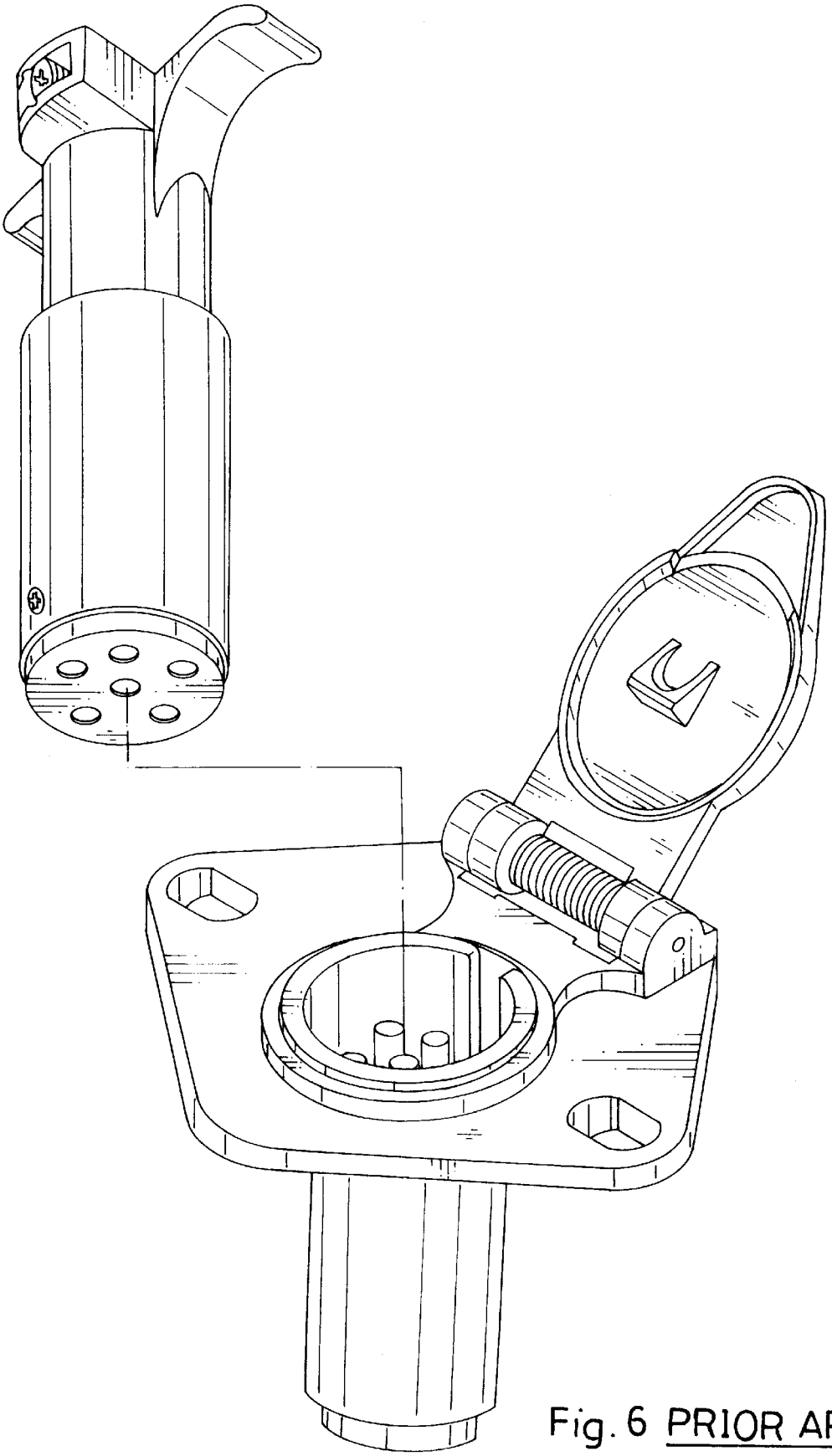
Fig. 6 PRIOR ART
FIG. 6 shows the relationship between the electrical female connector and the electrical male connector according to the prior art.
Figure 7:
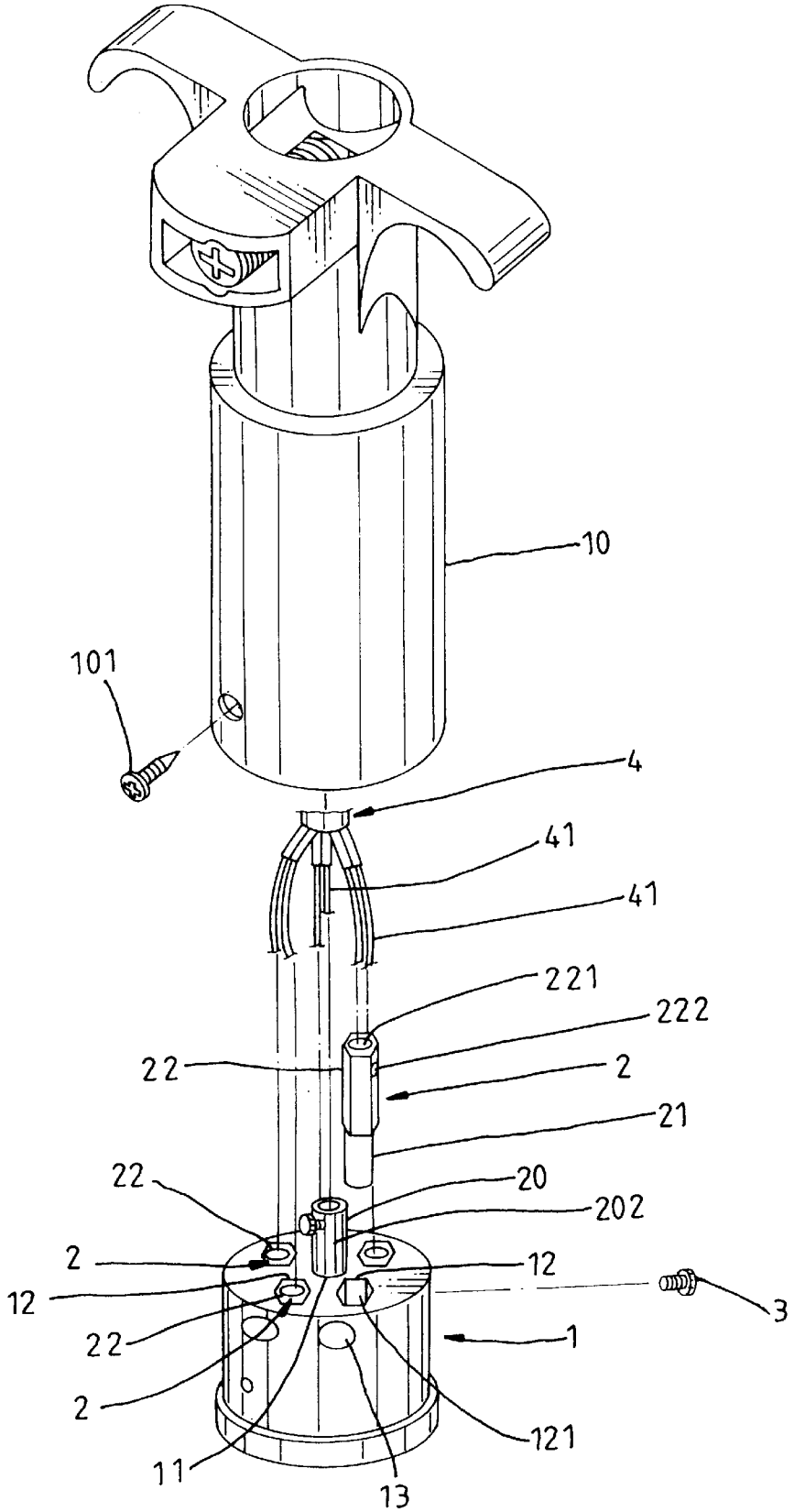
FIG. 7 is an exploded view of an electrical female connector for use in a caravan according to the present invention.
Figure 8:
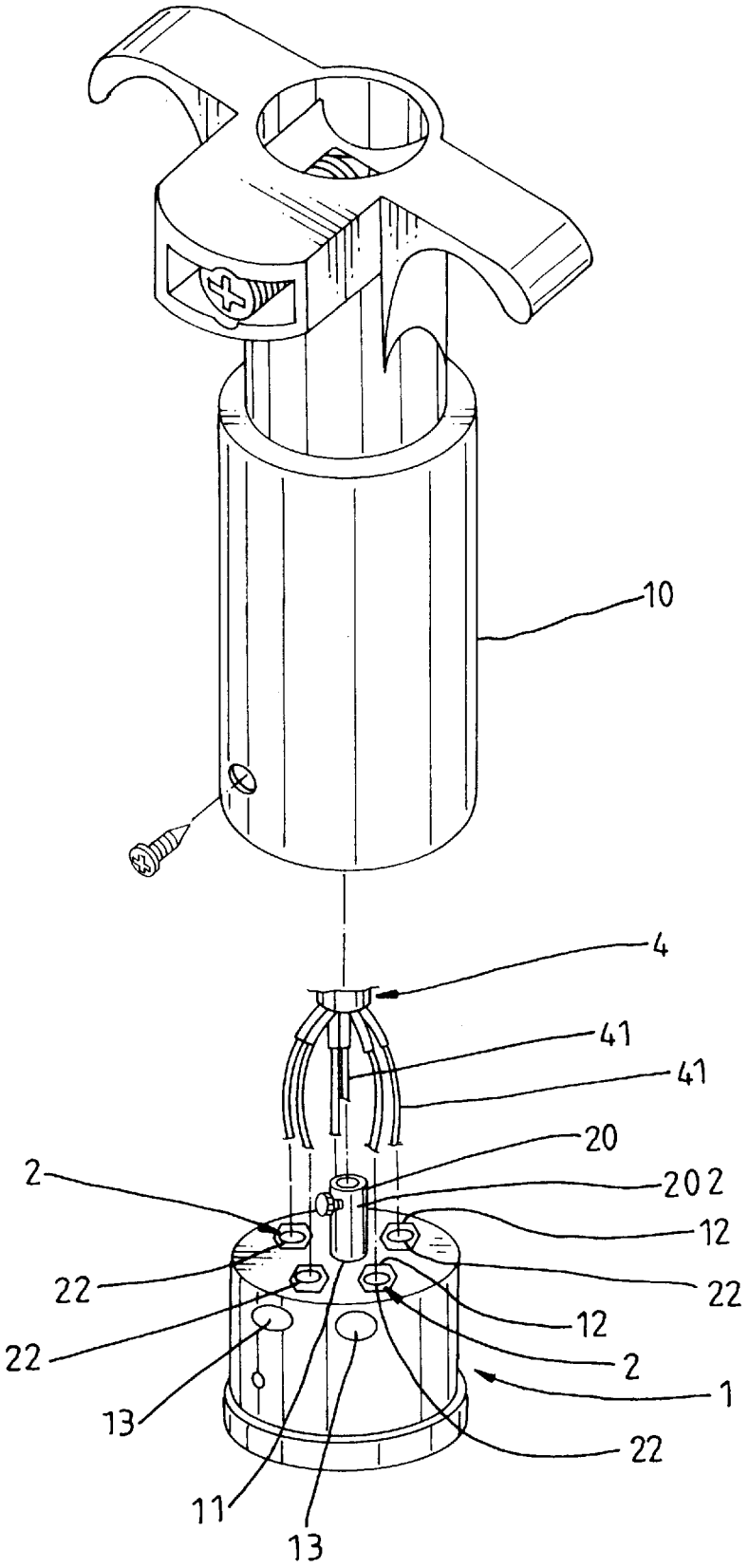
FIG. 8 is an assembly ivew of the electrical female connector according to the present invention.
Figure 9:
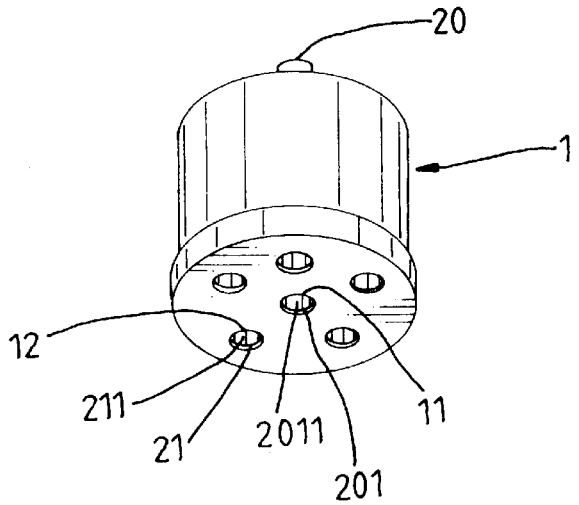
FIG. 9 is a perspective view of the connector body according to the present invention.
Figure 10:
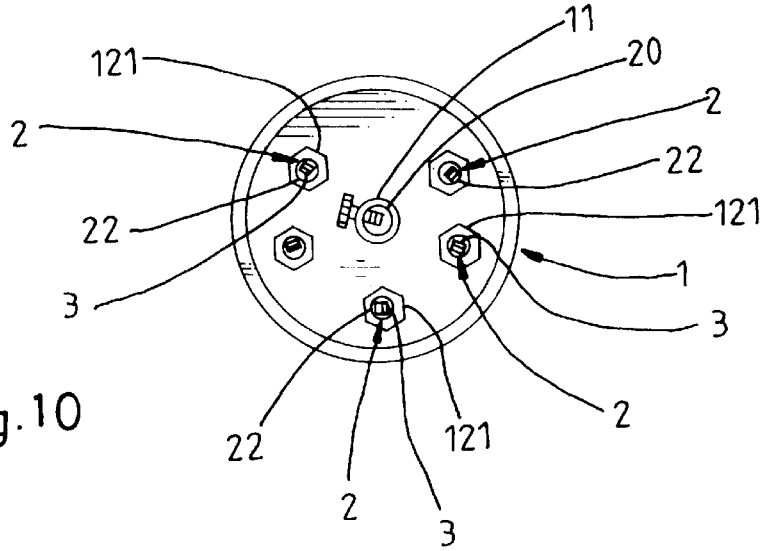
FIG. 10 is a top view of the electrical female connector according to the present invention.
Figure 11:
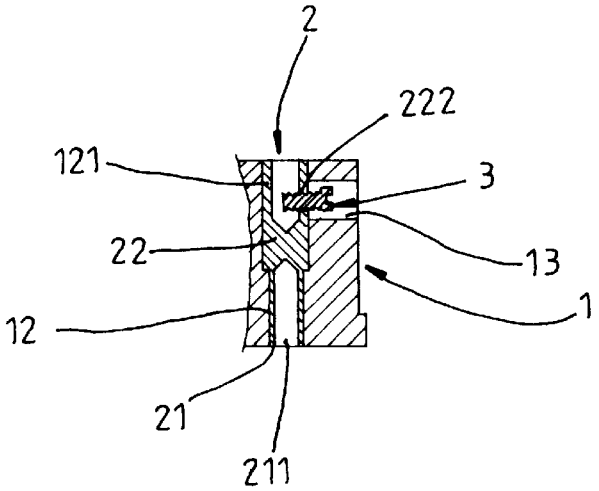
FIG. 11 is a sectional view of a part of electrical female connector according to the present invention.
Figure 12:
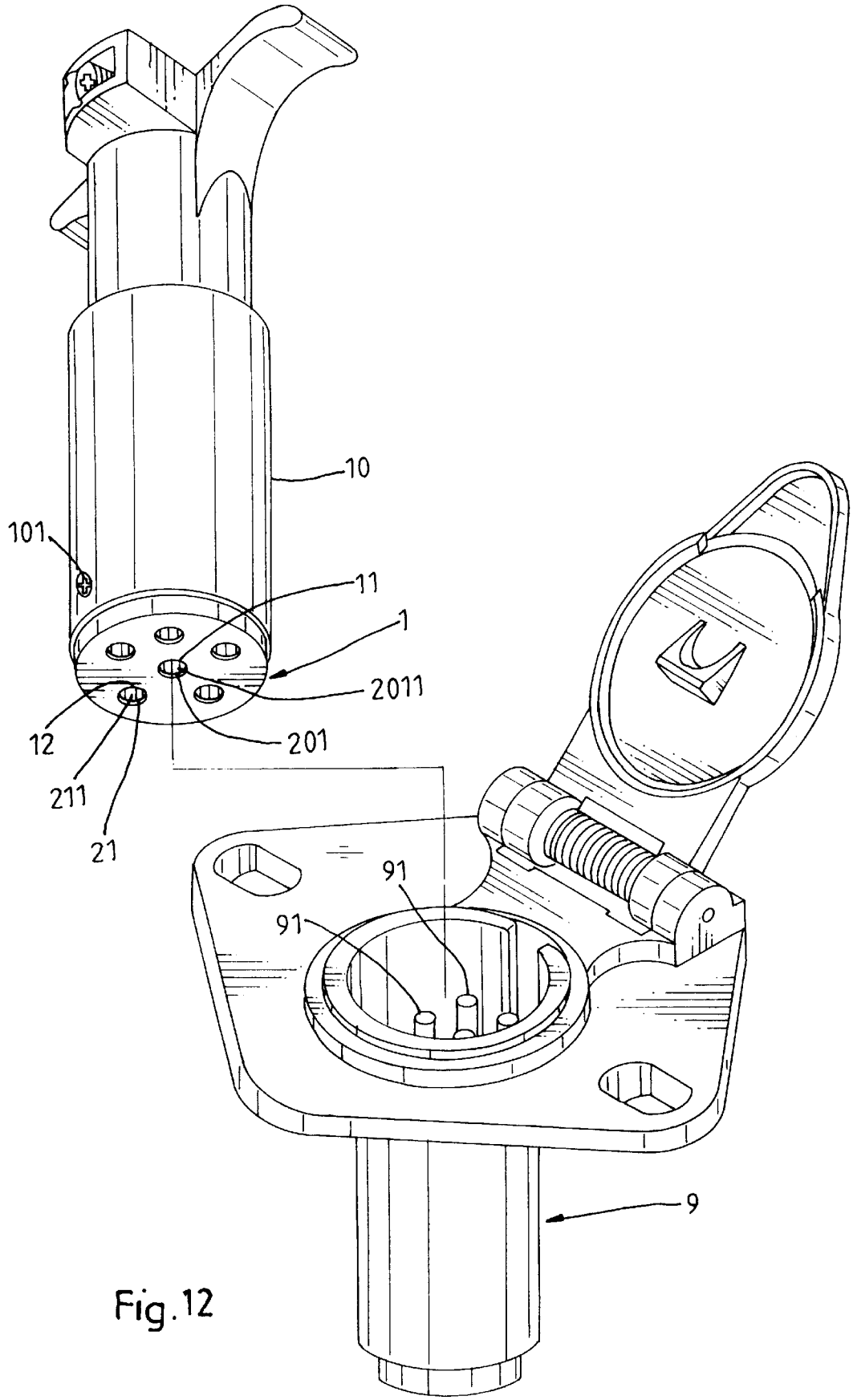
FIG. 12 shows the relationship between the electrical female connector and the electrical male connector according to the present invention.

Referring to Figures from 7 through 12, an electrical female connector in accordance with the present invention is generally comprised of a housing 10, and a connector body 1. The connector body 1 is mounted in the housing 10, and fixedly secured in place by screws 101. The connector body 1 comprises an axially extended center through hole 11, and a plurality of axially extended border through holes 12 spaced around the center through hole 11. A first terminal 20 and a plurality of second terminals 2 are respective mounted in the through holes 11 and 12. The first terminal 20 is longer than the second terminals 2, having an upper wire connecting portion 202 extended out of the connector body 1, and a lower mounting portion 201 plugged into the center throug hole 11 on the connector body 1 and defining a plug hole 2011 for receiving one terminal 91 of the electrical male connector 9 (see FIG. 12). The second terminals 2 each comprise an upper wire connecting portion 22, and lower mounting portion 21. The upper wire connection portion 22 has an axial wire hole 221, and a radial screw hole 222 in communication with the axial wire hole 221. The lower mounting portion 21 defines a plug hole 211 for receiving one terminal 91 of the electrical male connector 9. When one electrical wire 41 of the cable 4 being inserted into the housing 10 is inserted into the axial wire hole 221 at one second terminal 2, a screw 3 is threaded into the respective radial screw hole 222 to fix the inserted electrical wire 41 in position.

The connector body 1 has a plurality of radial through holes 13 spaced around the periphery. The border through holes 12 of the connector body 1 are stepped holes, each having a hexagonal upper section 121 (of greater diameter relative to its lower section) respectively disposed in communication with the radial through holes 13. The second terminals 2 respectively fit the stepped border through holes 12. The upper wire connecting portion 22 of each second terminal 2 has a hexagonal cross section fitting the hexagonal upper section 121 of each border through hole 12. When the second terminals 2 are respectively inserted into the border through holes 12, they are prohibited from rotary motion (because the hexagonal upper wire connecting portion 22 of each second terminal 2 fits the hexagonal upper section 121 of the respective border through hole 12), and the respective screw holes 222 at the second terminals 2 are respectively set into alignment with the respective radial through holes 13 at the connector body 1, enabling the respective screws 3 to be conveniently inserted into the respective radial through holes 13 and threaded into the respective screw holes 222 to fix the respective electircal wires 41 to the upper wire connecting portions 22 of the respective second terminals 2. Further, the axial length of the hexagonal upper wire connecting portion 22 of each second terminal 2 is shorter than the hexagonal upper section 121 of each border through hole 12. After installation of the first terminal 20 and the second terminals 2 in the respective throug holes 11 and 12, the hexagonal upper wire connecting portions 22 of the second terminals 2 are completely received inside the respective hesagonal upper section 121 of the respective border through holes 12, and the hexagonal upper wire connecting portion 202 of the first terminal 20 is extended out of the connector body 1, therefore the conductors of the electrical wire 41 connected to the hexagonal upper wire connecting portion 202 of the first terminal 20 kept away from the conductors of the electrical wires 41 connected to the hexagonal upper wire connecting portions 22 of the second terminals 2 to void a short circuit.

As indicated above, the present invention is characterized in that:

1. the border through holes 12 of the connector body 1 each have a hexagonal upper sections 121 so that the hexagonal second terminals 2 can be easily set into position;
2. the connector body 1 has radial through holes 13 respectively disposed in communication with the axially extended border through holes 12 for installation of screws 3 in the screw holes 222 at the second terminals 2 to fix the respective electrical wires 41 to the second terminals 2 and the stop the respective terminals 2 from axial movement in the respective border through holes 12 (because installed screws 3 each have a part respectively maintained in the respective radial through holes 13);
3. a screwdriver can be inserted into each radial through hole 13 at the connector body 1 to fasten each screw 3 to each second terminal 2 without causing a short circuit.
4. the axial length of the hexagonal upper wire connecting portion 22 of each second terminal 2 is shorter than the hexagonal upper section 121 of each border through hole 12, so that the hexagonal upper wire connecting portions 22 of the second terminals 2 can be completely received inisde the respective hexagonal upper section 121 of the respective border through holes 12, and the conductors of the electrical wire 41 connected to the hexagonal upper wire connecting portion 202 of the first terminal 20 can be kept away from the conductors of the electrical wires 41 connected to the hexagonal upper wire connecting portions 22 of the second terminals 2 to void a short circuit.

I claim:

1. An electrical female connector installed in a caravan for connection to a matching electrical male connector, the electrical female connector comprising a housing, a cable fastened to said housing, said cable comprising a plurality of electrical wires, a connector body mounted within said housing, said connector body comprising an axially extended center through hole and a plurality of axially extended border through holes spaced around said axially extended center through hole, a first terminal and a plurality of second terminals respectively mounted in the axially extended center through hole and border through holes at said connector body, said first terminal and second terminals each having an upper wire connecting portion defining an axial wire hole for receiving the electrical wires of said cable respectively, and a lower mounting portion defining a plug hole for receiving respective terminals of the matching electrical male connector, wherein, said connector body comprises a plurality of radial through holes spaced around the periphery thereof and respectively disposed in communication with said axially extended border through holes; the axially extended border through holes of said connector body are stepped through holes, each having a hexagonal upper section of greater diameter for receiving the upper wire connecting portions of said second terminals, and a lower section of smaller diameter for receiving the lower mounting portions of said second terminals; the upepr wire connecting portions of said second terminals each have a hexagonal cross section respectively fitted into the hexagonal upper sections of said axially extended border through holes at said connector body, the axial length of the hexagonal cross sections of said second terminals being shorter than the axial length of the hexagonal upper sections of said axially extended border through holes.

* * * * *